US005370338A

United States Patent [19]

Lewis

[11] Patent Number: 5,370,338

[45] Date of Patent: Dec. 6, 1994

[54] VARIABLE ORIFICE CENTERFLOW DISPENSER

[75] Inventor: Richard P. Lewis, Oaks, Pa.

[73] Assignee: Scott Paper Company, Philadelphia, Pa.

[21] Appl. No.: 951,358

[22] Filed: Sep. 25, 1992

Related U.S. Application Data

[63] Continuation of Ser. No. 740,167, Aug. 5, 1991, abandoned, which is a continuation of Ser. No. 545,156, Jun. 28, 1990, abandoned.

[51] Int. Cl.[5] ..... B65H 23/04

[52] U.S. Cl. ..... 242/593; 242/615.3; 242/615.4; 242/132; 242/137; 206/409; 220/253

[58] Field of Search ..... 242/55.42, 55.54, 55.53, 242/132, 137, 146, 593, 615.3, 615.4; 206/390, 394, 409, 205, 210, 812; 220/253; 221/63

[56] References Cited

U.S. PATENT DOCUMENTS

| | | | |
|---|---|---|---|
| 285,995 | 10/1986 | Minost | D6/552 |
| 293,058 | 12/1987 | Iwarsson | D6/523 |
| 995,203 | 6/1911 | Thomas et al. | 220/253 |
| 2,606,087 | 8/1952 | Tansley | 312/43 |
| 2,780,388 | 2/1957 | Stephenson | 221/44 |
| 3,523,653 | 8/1970 | Hanson | 242/55.54 |
| 3,603,519 | 9/1971 | Brown et al. | 242/55.53 |
| 3,627,216 | 12/1971 | Ekuan | 242/55.54 |
| 3,923,223 | 12/1975 | Larsson et al. | 225/46 |
| 4,171,047 | 10/1979 | Doyle et al. | 206/210 |
| 4,181,218 | 1/1980 | Cox | 242/55.54 |
| 4,262,816 | 4/1981 | Margulies | 206/409 |
| 4,460,106 | 7/1984 | Moulding, Jr. et al. | 221/1 |
| 4,524,895 | 6/1985 | Lunden | 225/19 |
| 4,526,291 | 7/1985 | Margulies | 206/409 |
| 4,579,266 | 4/1986 | Bunger et al. | 225/19 |
| 4,756,460 | 7/1988 | Ornros | 225/54 |
| 4,760,970 | 8/1988 | Larsson et al. | 242/55.54 |
| 4,979,617 | 12/1990 | Benoit | 206/390 |

FOREIGN PATENT DOCUMENTS

| | | | |
|---|---|---|---|
| 107487 | 5/1984 | European Pat. Off. | 242/55.54 |

*Primary Examiner*—Stanley N. Gilreath
*Assistant Examiner*—John Q. Nguyen
*Attorney, Agent, or Firm*—M. G. Bocchetti; J. W. Kane, Jr.

[57] ABSTRACT

A centerflow dispenser for dispensing a rolled paper product which includes a device for varying the diameter of the dispensing orifice to accommodate rolled paper products of various weights, widths, bulks and tensile strengths. The dispenser includes a rear housing, a front housing pivotally attached to the rear housing, the rear housing having extending therefrom a support member or bottom housing upon which a rolled paper product is placed. In one embodiment, the support member has attached thereto a rotatable disk with a plurality of a different diameter orifices disposed in the periphery thereof. The disk can be rotated such that each orifice in turn comes in at a vertical overlapping relationship with an exit port in the support member. In such manner, the desired orifice can be selected for the particular paper product being dispensed.

In a second embodiment, interchangeable U-shaped members are supplied, each having a different diameter orifice therein. A particular U-shaped member having the desired orifice is selected for the paper product to be dispensed and it is inserted in overlapping vertical relation to an exit port in the support member.

19 Claims, 5 Drawing Sheets

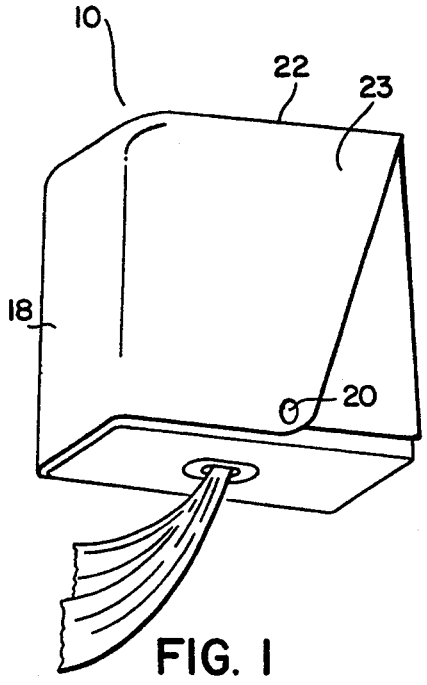
FIG. 1
FIG. 2
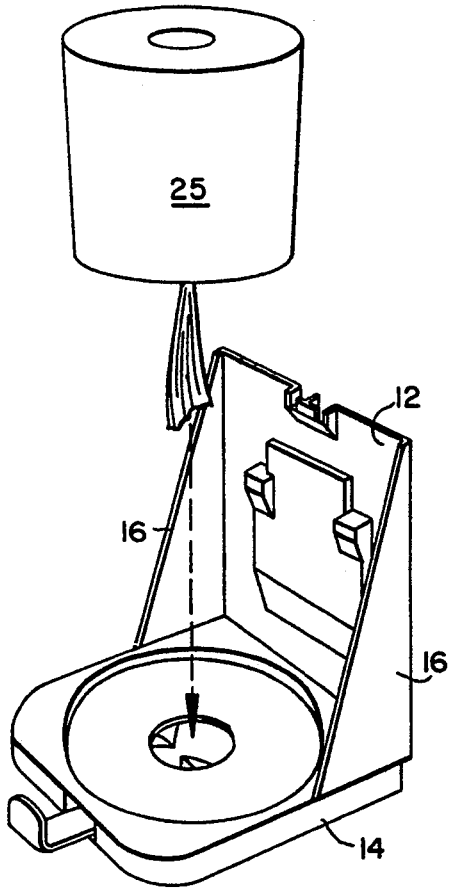
FIG. 5
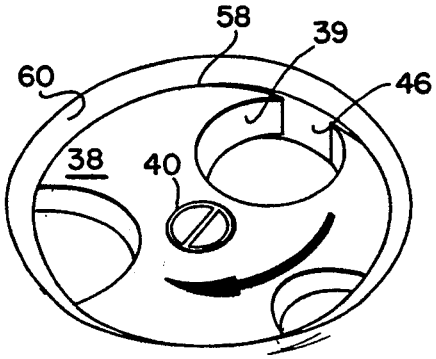

VARIABLE ORIFICE CENTERFLOW DISPENSER

This application is a continuation of application Ser. No. 07/740,167, filed Aug. 5, 1991 which is a continuation of application Ser. No. 07/545,156, filed Jun. 28, 1990, both abandoned.

BACKGROUND OF THE INVENTION

1. Field of the Invention

This invention relates generally to dispensers for rolled paper webs and, more particularly, to centerflow dispensers for rolled paper webs in which the web is unrolled axially from the center of the roll.

2. Brief Description of the Prior Art

A variety of centerflow dispensing devices are known in the prior art. When such dispenser is taught in U.S. Pat. No. 4,579,266 to Bunger, et al. The dispenser taught by Bunger, et al. includes a supporting surface on which a paper roll resides. Further, there is a hood which engages that supporting surface to enclose the paper roll. An orifice is provided through the supporting surface and teeth are provided at the periphery of the orifice to provide a ripping edge.

U.S. Pat. No. 4,760,970 to Larsson, et al. teaches a centerflow dispenser which includes a paper holder upon which a paper roll vertically rests. A cylindrical cover is provided to enclose the paper roll and the paper is dispensed through an orifice extending through the bottom of the holder.

U.S. Pat. No. 4,524,895 to Lunden teaches a centerflow dispenser which utilizes a supporting end wall on which a paper roll vertically rests. A cylindrical sleeve is provided which engages the end wall for enclosing the paper roll. Paper is dispensed through an orifice in the end wall. A tearing means is provided at the base of the orifice which includes protective projections having a substantially sine wave shaped free edges with a wave amplitude substantially greater than the length of the tearing teeth.

U.S. Pat. No. 4,756,460 to Ornros teaches a rolled paper dispenser wherein paper is dispensed from the outside of the paper roll through a helical slot in the paper roll holder.

There is taught in U.S. Pat. No. 3,923,223 to Larsson et al. a centerflow paper roll dispenser which includes a bearing plate on which a paper roll vertically rests. Extending downward from the bearing plate is a tubular-shaped tear-off mechanism providing an orifice through which the paper is dispensed.

U.S. Pat. No. 3,627,216 to Ekuan teaches a rolled paper receptacle which has a cover shaped like an inverted funnel with an orifice at the top thereof. A coreless roll of paper may be pulled vertically up through the inverted funnel and orifice therein.

Nothing in the prior art teaches a centerflow dispensing device for use with coreless rolled paper products which includes a dispensing orifice which can be dimensionally varied to accommodate a variety of rolled paper products efficiently.

SUMMARY OF THE INVENTION

It is therefore an object of the present invention to provide a dispenser for rolled paper webs wherein the diameter of the dispensing orifice can be varied to accommodate different rolled paper products.

It is a further object of the present invention to provide a centerflow dispenser which is adaptable for use with rolled paper webs of different bulks, as well as different weights, widths and tensile strengths.

Another object of the present invention is to provide a variable orifice centerflow dispenser through which a variety of paper webs can be dispensed from a bottom port therein.

It is a further object of the present invention to provide a centerflow dispenser which incorporates a large exit port through which the rolled paper product can be initially, easily inserted.

Still another object of the present invention is to provide a centerflow dispenser wherein the diameter of the dispensing orifice can be varied after the rolled paper product has been inserted through the exit port.

Briefly stated, the foregoing and numerous other features, objects and advantages of the present invention will become readily apparent upon a reading of the detailed description, claims and drawings set forth hereinafter. These features, objects and advantages are accomplished by constructing a centerflow rolled paper dispenser which has a drawer incorporated into the bottom wall of the dispenser. Rotatably attached to the drawer is a disk member having a plurality of orifices disposed in the periphery thereof such that the desired diameter orifice can be rotated into alignment with the exit port of the dispenser. Alternatively, these features, objects, and advantages may be accomplished through the use of drawer member mounted in the bottom wall of the dispenser wherein the drawer includes a recess for receiving interchangeable plate members. Each of the individual plate members includes an orifice at the lead edge thereof. With both embodiments, the drawer member can be moved outwardly from the dispenser to expose a large exit port through which the lead edge of the paper web can be easily fed. The desired orifice can be selected and the drawer closed to provide the proper restriction orifice for the web from the dispenser.

A door is provided to the dispenser to fully enclose the rolled paper web within the dispenser. The door is hingedly connected to the support member of the dispenser such that when it is closed, it covers the drawer member and therefor the drawer member cannot be opened without first opening the door of the dispenser.

BRIEF DESCRIPTION OF THE DRAWINGS

FIG. 1 is an isometric view of the centerflow dispenser of the present invention.

FIG. 2 is an isometric view of the centerflow dispenser of the present invention with the door removed and the rolled paper product exploded.

FIG. 5 is an isometric detail of the exit port with the drawer fully inserted.

DETAILED DESCRIPTION OF THE PREFERRED EMBODIMENT

Figure 3:
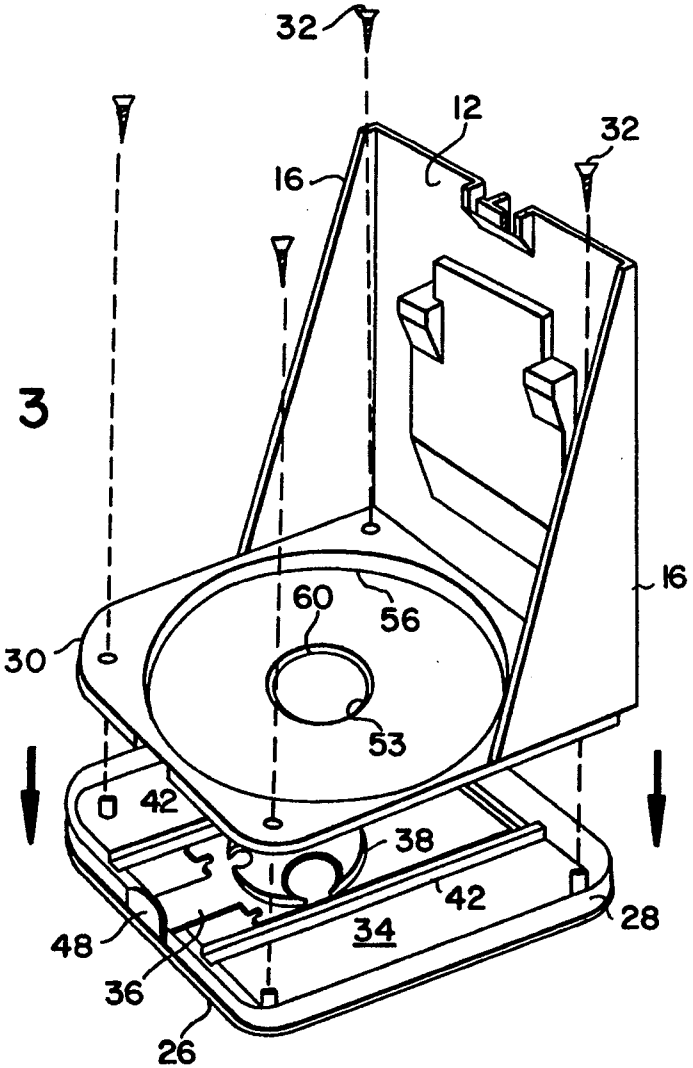
FIG. 3 is an isometric view of the centerflow dispenser of the present invention with the door removed with the lower wall exploded from the rear housing.

Turning first to FIG. 1, there is shown the centerflow dispenser 10 of the present invention. The centerflow dispenser 10 includes a wall mounting plate 12 (shown in FIGS. 2 and 3.) which has affixed thereto and extending 90 degrees out therefrom lower housing or support member 14. Providing additional structural integrity for lower housing or support member 14 are brackets 16 which extend outwardly from wall mounting plate 12.

The dispenser 10 of the present invention is provided with a door or front housing 18 which pivotally connects to lower housing 14 by means of pins 20. Door or front housing 18 includes a top or lid section 22 and the side sections 23. Thus when a rolled paper product 25 is placed on lower housing 14 and door or front housing 18 is closed, the rolled paper web 25 is substantially enclosed such that access to the web is only through the lower exit port 24 (see FIG. 4) in support member or lower housing 14.

Lower housing 14 is comprised of lower wall 26 having peripheral wall member 28 extending upwardly therefrom and cover or lid 30. Lower wall 26 is attached to cover or lid 30 by means of screws 32. Attachment of cover 30 to lower wall 26 creates a chamber 34 within lower housing 14. Contained within chamber 34 is drawer 36. There is a disk 38 rotatably attached to drawer 36 by means of pin 40. Disk 38 has a plurality of dispensing orifices 39 disposed in the periphery thereof. The dispensing orifices 39 vary in diameter.

Figure 4:
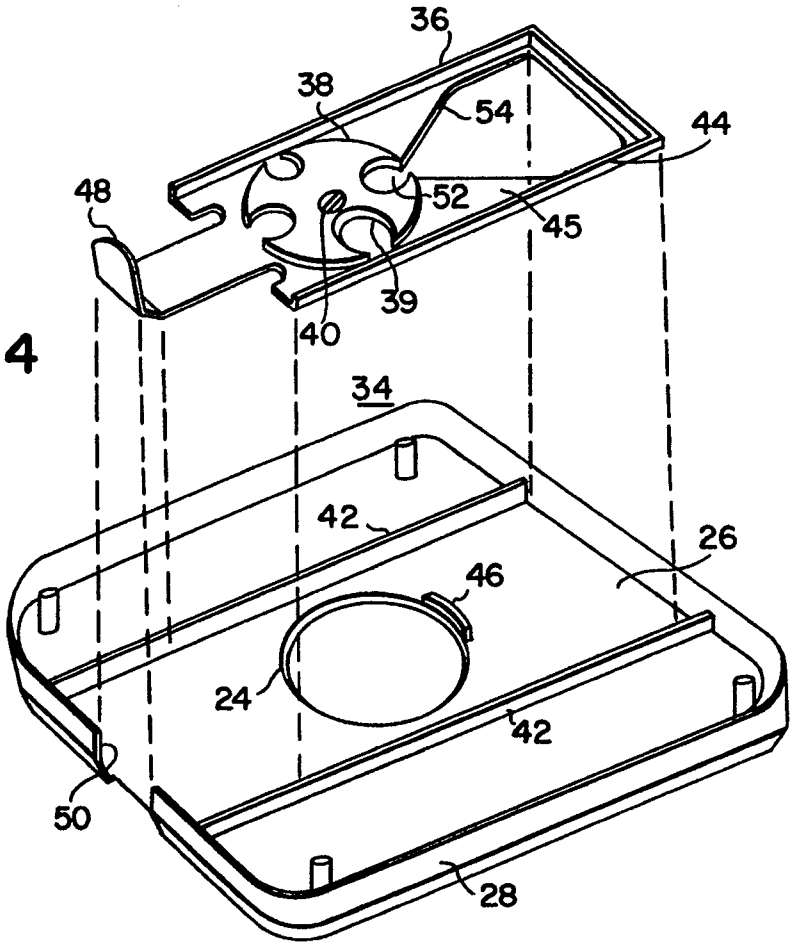
FIG. 4 is an isometric view of the lower wall of the dispenser with the drawer exploded.

As shown more clearly in FIG. 4, lower wall 26 of lower housing 14 has guide members 42 extending upwardly therefrom. That area of chamber 34 between guide numbers 42 provide a residence for drawer 36. Drawer 36 includes a peripheral lip 44 extending upward from a planar surface 45. Peripheral lip 44 is greater in height than the thickness of disk 38. The width of lip 44 is substantially equal to the height of guide members 42. In such manner, it is assured that when cover 30 is mounted to lower wall 26, cover 30 will not bind disk 38 to such extent that disk 38 cannot be easily, manually rotated. Also extending upward from lower wall 26 is stop member 46. Stop member 46 is preferably arcuate having a radius substantially similar to the radius of lower exit port 24.

Drawer 36 includes handle member 48 which extends through notch 50 in peripheral wall 28. Drawer 36 further includes hole 52 which has a diameter equal to or greater than the diameter of the largest of orifices 39 in disk 38. Extending from hole 52 in drawer 36 is V-shaped opening 54 such that the point of the "V" (or point of convergence), if projected would converge and terminate within hole 52. Although opening 54 is preferably V-shaped, the shape of opening 54 may be varied so long as the sides of opening 54 remain substantially divergent.

Figure 6:
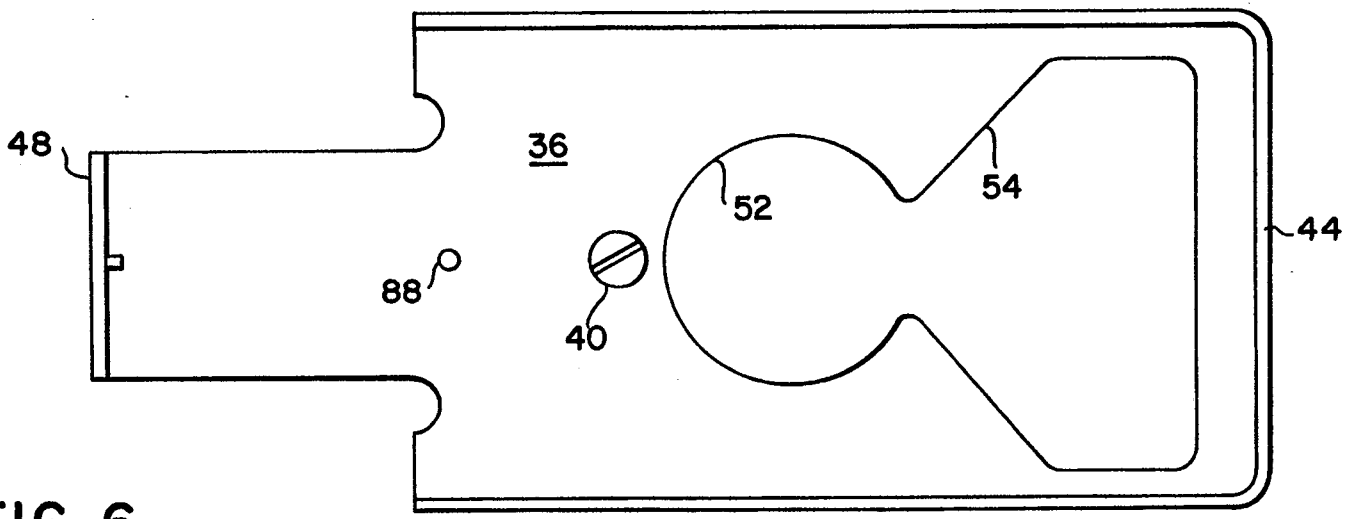
FIG. 6 is a plan view of the drawer of the preferred embodiment with the disk removed therefrom.
Figure 8:
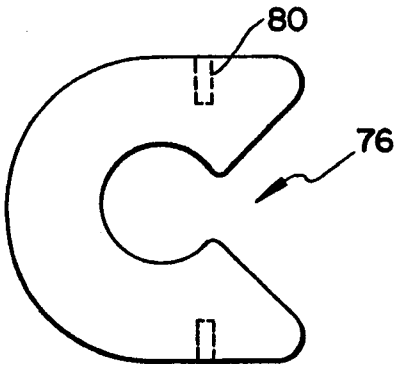
FIG. 8 is a plan view of one of the orifice members for use with the alternative embodiment drawer depicted in FIG. 7.
Figure 9:
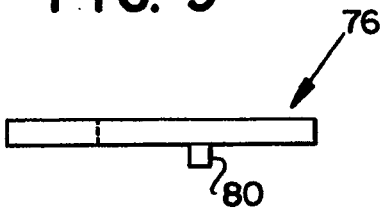
FIG. 9 is a side elevation of one of the orifice members for use with the alternative embodiment drawer depicted in FIG. 7.
Figure 10:
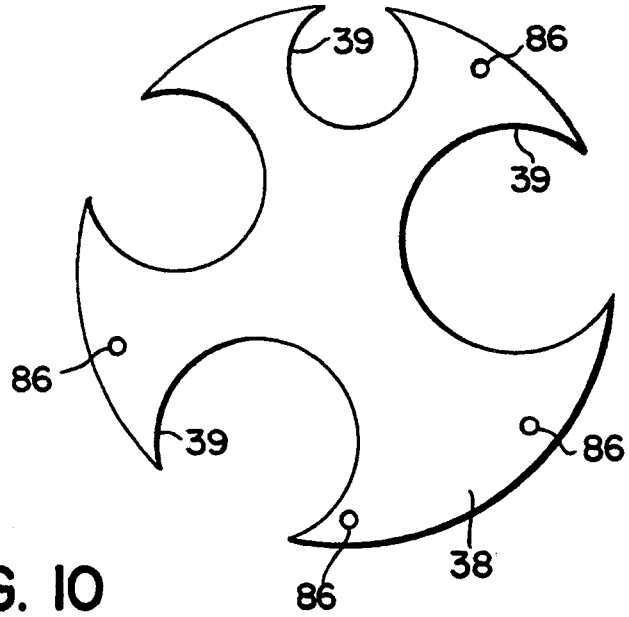
FIG. 10 is a bottom plan view of the disk.

Cover 30 includes a circular recess 56 in which the rolled paper web 25 rests. The cylindrical diameter of the circular recess 56 should therefore, preferably, be equal to or greater than the diameter of the rolled paper web. Cover 30 includes an upper exit port 58 therethrough which is substantially concentric with circular recess 56. Extending downward from upper exit port 58 is tapered lip 60 making upper exit port 58 funnelled or frusto-conical in shape. Upper exit port 58 is in substantial vertical alignment with lower exit port 24 and is of like diameter. When drawer 36 is fully inserted into chamber 34 between guide members 42, hole 52 overlaps or aligns nonconcentricly with lower exit port 24 and upper exit port 58. Disk 38 can be rotated such that each of the orifices 39 can be rotated into a position to vertically overlap or align with hole 52. Tapered lip 60 extends down to contact disk 38. Thus, although disk 38 can be manually rotated, the contact between disk 38 and lip 60 as well as between disk 38 and drawer 36 ensures that there is resistance to the free spinning of disk 38. Drawer 36 and disk 38 are also provided with a detent arrangement to prevent unintentional rotation of disk 38. As shown in FIG. 10, the bottom surface of disk 38 includes a series of indentations 86. Each indentation 86 is spaced 180° from a particular orifice 39. As disk 38 is rotated to select an orifice 39, the indentation 86 opposite the selected orifice 39 will engage protuberance 88 on drawer 36 (see FIG. 6). Therefore, once the desired orifice is selected, the action of pulling the paper web 25 through exit ports 24 and 58 will not impart rotational movement to disk 38.

To load the centerflow dispenser 10 of the present invention, door 18 is unlocked and pivoted downwardly thereby exposing handle 48 of drawer 36. Handle 48 can thus be grasped and pulled outwardly from peripheral wall 28 thereby bringing V-shaped opening 54 in vertical alignment with lower exit port 24 and upper exit port 58. Arcuate extension 46 serves as a travel stop for drawer 36 when handle 48 is pulled outwardly thus insuring that all or at least a portion of selected orifice 39 will still reside in vertical alignment with lower exit port 24 and upper exit port 58. In such manner, a large opening is provided through which the lead end of the rolled paper web 25 can be easily inserted. Before the lead end of the paper web 25 is inserted, disk 38 is rotated to a position aligning the desired orifice 39 with hole 52. After the lead end of rolled paper web 25 has been pulled through, the user need only push handle 48 thereby driving drawer 36 back into fully inserted position in chamber 34. Therefore, the combination of drawer 36 and V-shaped opening 54 form a means for enlarging the opening through which the lead end of rolled paper web 25 is inserted when the dispenser of the present invention is loaded. This means for enlarging is a significant advantage when initially feeding the lead end of rolled paper web 25 through such opening when it is understood that the diameter of a dispensing orifice 39 may be on the order of $\frac{3}{8}$ of an inch. The rolled paper web 25 can then be placed on cover 30 and door 18 closed. As drawer 36 is being closed, it may be necessary for the person loading the dispenser to bunch that portion of the lead end of paper web 25 which is in close proximity to the exit ports 24 and 58 toward hole 52 and selected orifice 39. This will aid in preventing a portion of the web 25 from being caught outside of selected orifice 39. However, it should be recognized that the V-shaped opening 54 automatically promotes the bunching of the web 25 into hole 52 as drawer 36 is inserted.

Handle 48 and cover 30 are provided with a locking detent mechanism (not shown). The detent mechanism prevents the forced exerted on drawer 36 during dispensing from urging drawer 36 against door 18 which, in turn, prevents V-shaped opening 54 from moving into overlapping vertical alignment with exit ports 24 and 58. Such movement of V-shaped opening 54 during dispensing could result in snagging of the web.

In the alternative, rather than providing handle 48 and cover 30 with a detent mechanism, drawer 36 can be spring biased to be urged into the closed position unless held in the open position by the operator. Further, door 18 can be closely toleranced to reside in abutting relation with handle 48 upon the closing of both door 18 and drawer 36 thus eliminating the need for the detent mechanism. In such manner, drawer 36 will be provided no room for lateral movement during dispensing. If door 18 is so closely toleranced to reside in abutting position with handle 48, then it may be desirable to spring bias drawer 36 such that it automatically opens upon the opening of door 38.

Figure 11:
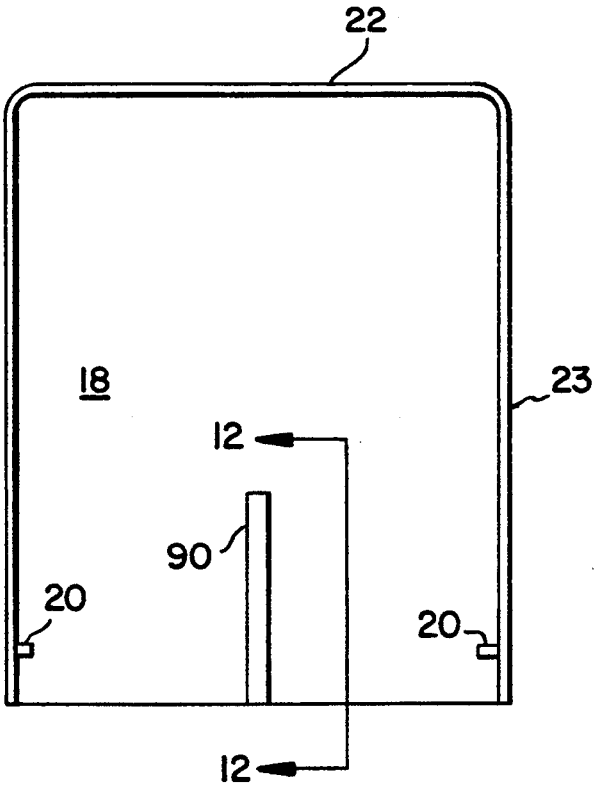
FIG. 11 is an elevation of the inside of the door.
Figure 12:
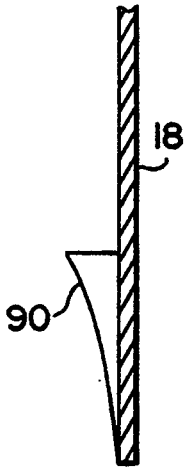
FIG. 12 is a partial cross section taken along line 12—12 of FIG. 11.

In the preferred embodiment, door 18 is provided with a closing rib 90 on the inside surface thereof. (See FIGS. 11 & 12). If the operator attempts to close door 18 without first closing drawer 36, closing rib 90 will contact handle 48 and as door 18 is rotated to a closed position, closing rib 90 will urge handle 48 and drawer 36 to a closed position.

Figure 7:
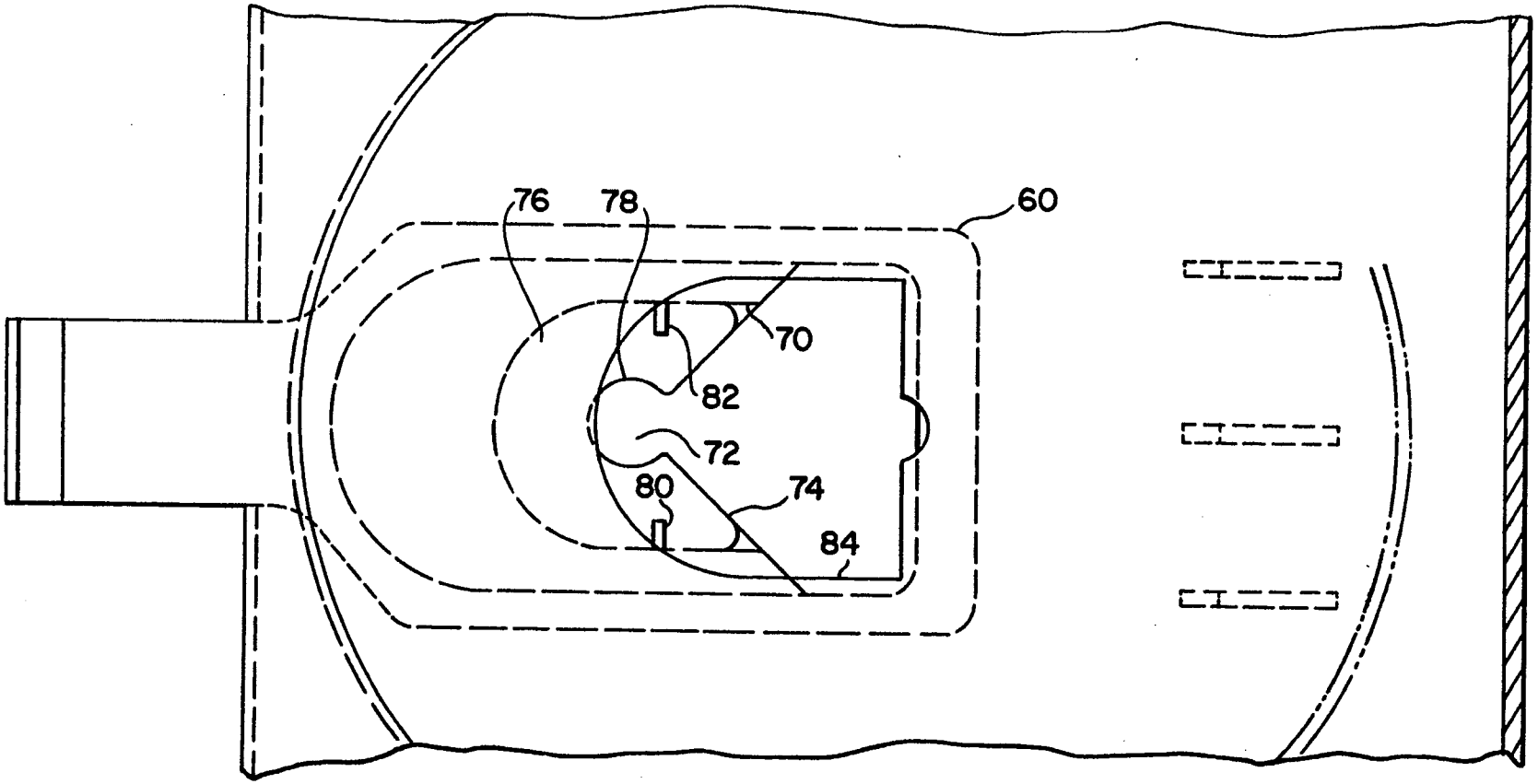
FIG. 7 is a partial plan view showing the drawer of an alternative embodiment of the present invention partially withdrawn from the lower housing.

In an alternative embodiment an alternative drawer 60 can be used as shown in FIG. 7. In such embodiment, drawer 60 includes a recessed lip 70, a hole 72 and a U-shaped opening 74. Recessed lip 70 is adapted to receive U-shaped orifice member 76. There are a plurality of U-shaped orifice members 76 each having a different diameter restriction orifice 78 therethrough. U-Shaped orifice member 76 has extending downward therefrom key members 80 which insert into notches 82 in recessed lip 70 thus preventing movement of U-shaped member 76 relative to drawer 36.

Although the figures depict dispensing orifices 39 and 78 as being substantially circular, it should be recognized that dispensing orifices 39 and 78 could be any of a variety of geometric shapes such as, for example, elliptical or polygonal. Therefore, as used herein, the term diameter is defined as a chord passing through the center of a figure.

To accommodate the use of U-shaped orifice members 76 with drawer 60, cover 30 must include an opening 84 large enough such that U-shaped member 76 can be inserted therethrough to reside on recessed lip 70. Once the U-shaped member 76 containing the desired orifice is selected, it is inserted through opening 84 and onto recessed lip 70 such that keys 80 engage with notches 82. Handle 48 can then be withdrawn aligning V-shaped opening 74 with lower exit port 24 and opening 84. As with the first embodiment discussed above, this second embodiment allows for easy placement of the lead edge of the rolled paper web 25 through an enlarged opening. The drawer 60 can then be pushed inward such that the paper web becomes enclosed within the orifice of the selected U-shaped orifice member 76.

From the foregoing, it will seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A centerflow rolled paper dispenser comprising:
(a) an upper housing;
(b) a support member within said upper housing for supporting a roll of paper;
(c) a lower housing attached to said upper housing;
(d) an exit port from said upper housing to said lower housing;
(e) means within said lower housing for positioning any one of a plurality of user interchangeable dispensing orifices of differing diameters such that the roll can be dispensed from the center of the roll through a selected one of said plurality of dispensing orifices, said means for positioning including a drawer member slidably engageable with said lower housing and supporting said selected one of said orifices in substantially overlapping position with said exit port.

2. A centerflow rolled paper dispenser as recited in claim 1 wherein:
said means for positioning further comprises a disk with said plurality of orifices disposed in the periphery thereof, said disk being rotatably supported on said drawer member.

3. A centerflow rolled paper dispenser as recited in claim 1 wherein:
said means for positioning further comprising a plate member releasably supported within said lower housing, said plate member having said dispensing orifice therethrough, said plate member being selectable by a user from a plurality of interchangeable plate members, each of said plate members having one of said plurality dispensing orifices therethrough thereby allowing the user to vary the diameter of said dispensing orifice by replacing said plate member with another one of said plurality of interchangeable plate members.

4. A centerflow rolled paper dispenser comprising:
(a) an upper housing for containing a roll of paper;
(b) a lower housing mounted below said upper housing;
(c) an exit port from said upper housing to said lower housing through which the roll of paper is dispensed from the center of the roll;
(d) a dispensing orifice in said lower housing through which said roll is dispensed, said dispensing orifice having a fixed diameter, said dispensing orifice selected from a plurality of dispensing orifices of differing fixed diameters;
(e) means within said lower housing for interchanging one of said plurality of dispensing orifices for another of said plurality of dispensing orifices;
(f) a drawer member slidably engaged with said lower housing, said drawer member supporting said dispensing orifice in overlapping position with said exit port.

5. A centerflow rolled paper dispenser as recited in claim 4 wherein:
said drawer member is movable from an open position partially extending from said lower housing to a closed position substantially within said lower housing, said means for interchanging said dispensing orifices rotatably affixed to said drawer member.

6. A centerflow rolled paper dispenser as recited in claim 5 wherein:

said drawer member includes a planar base having a first opening therein, said first opening having substantially diverging sides with the point of convergence of said substantially diverging sides residing in a second opening through which the paper is dispensed, said second opening being smaller than said first opening and being contiguous with said first opening, said first opening allowing the paper to be more easily inserted through said drawer member and said exit port when said drawer member is in said open position.

7. A centerflow rolled paper dispenser as recited in claim 5 further comprising:

means for automatically closing said drawer member.

8. A centerflow rolled paper dispenser as recited in claim 5 further comprising:

(a) a front housing pivotally connected to said lower housing;

(b) means for simultaneously urging said drawer member to said closed position when said front housing is closed.

9. A centerflow rolled paper dispenser as recited in claim 5 further comprising:

(a) a front housing pivotally connected to said lower housing;

(b) a closing rib projecting from the inside surface of said front housing, said closing rib urging said drawer member to said closed position when said front housing is pivoted toward said upper housing while said drawer member is in said open position.

10. A centerflow rolled paper dispenser as recited in claim 4 wherein:

said means for interchanging further comprises means within said drawer member for receiving one of a plurality of U-shaped orifice members, said drawer member being movable from an open position partially extending from said housing to a closed position substantially within said housing, each of said U-shaped orifice members containing one of said dispensing orifices, each of said U-shaped orifice members having an opening at one end thereof, said opening having substantially diverging sides with the point of convergence of said substantially diverging sides residing within said dispensing orifice, said dispensing orifice being contiguous with said opening, said opening allowing the paper to be more easily inserted through said U-shaped orifice member and said exit port when said drawer member is in said open position.

11. A centerflow dispenser for dispensing a coreless rolled web comprising:

(a) a lower housing above which the rolled web is supported, said lower housing forming a first compartment;

(b) an upper housing mounted above said lower housing, said upper housing forming a second compartment, said second compartment for containing the rolled web, said first compartment having an opening therethrough into said second compartment;

(c) a disk rotatably residing within said lower housing, said disk having a plurality of orifices of differing diameters disposed through the periphery thereof;

(d) an exit port through said lower housing, the rolled web being dispensed from the center of the roll, through said opening and through said exit port, each of said orifices capable of being positioned to overlap said exit port by rotation of said disk so that the rolled web can be dispensed through a selected one of said orifices.

12. A centerflow rolled paper dispenser for dispensing a coreless roll of paper comprising:

(a) a disk rotatably affixed within a lower housing, said lower housing forming a compartment, said disk having a plurality of orifices through the periphery thereof; and (b) means for supporting the coreless roll of paper above said lower housing, said compartment having an opening in an upper surface thereof;

(c) an exit port through said lower housing, said disk residing in substantially overlapping relation with said exit port and said opening so that by rotation of said disk, each of said orifices can be substantially aligned with said exit port thereby allowing said roll of paper to be dispensed from the center of the roll through said opening, through a selected one of said orifices, and through said exit port.

13. A centerflow rolled paper dispenser as recited in claim 12 wherein:

each of said plurality of orifices is of a different diameter.

14. A centerflow rolled paper dispenser as recited in claim 12 wherein:

the size of each said orifices differs from the remainder of said orifices.

15. A centerflow rolled paper dispenser as recited in claim 12 further comprising:

(a) a mounting plate extending from said lower housing, said mounting plate for mounting said dispenser to a supporting surface; and (b) front housing means pivotally connected to said lower housing for enclosing the coreless roll of paper between said mounting plate and said front housing.

16. A centerflow rolled paper dispenser comprising:

(a) a support member having at least one substantially planar surface for supporting a roll of paper, said planar surface being perpendicular to the axis of said roll;

(b) an exit port through said support member through which said roll is dispensed;

(c) a lower housing affixed to said support member;

(d) a drawer member slidably residing within said lower housing, said drawer member containing a dispensing orifice through which the roll is dispensed;

(e) an opening through said drawer member substantially larger than said dispensing orifice and contiguous with said dispensing orifice such that said drawer member is capable of being moved within said lower housing from a first position wherein said dispensing orifice substantially overlaps said exit port to a second position wherein said opening substantially overlaps said exit port.

17. A centerflow rolled paper dispenser as recited in claim 16 further comprising:

(a) a dispensing orifice residing adjacent to and in substantially vertical alignment with said exit port;

(b) means for varying the diameter of said dispensing orifice.

18. A centerflow rolled paper dispenser as recited in claim 16, further comprising:

a front housing pivotally connected to said lower housing, said front housing capable of residing in an open position and a closed position, said front housing preventing said drawer member from being moved to said second position when said front housing is in said closed position.

19. A centerflow rolled paper dispenser comprising:

(a) a housing;

(b) a support member within said housing for supporting a roll of paper;

(c) a drawer member slidably engageable with said housing beneath said support member, said drawer member being movable from an open position partially extending from said housing to a closed position substantially within said housing;

(d) a rigid plate member releasably supported on said drawer member, said rigid plate member having a dispensing orifice of fixed diameter therethrough, said rigid plate member being selectable by a user from a plurality of interchangeable plate members each having a dispensing orifice therethrough having a different diameter thereby allowing the user to vary the diameter of said dispensing orifice by replacing said plate member with another one of said plurality of plate members, said drawer member allowing for the placement and removal of said interchangeable plate members when moved to said open position, said drawer member positioning said dispensing orifice such that the cylindrical axis of said roll intersects said dispensing orifice when said drawer member is moved to said closed position.

* * * * *